US005722221A

United States Patent [19]

Maltman et al.

[11] Patent Number: 5,722,221

[45] Date of Patent: Mar. 3, 1998

[54] ENVELOPE OPENING APPARATUS

[75] Inventors: Richard D. Maltman; Robert E. Valentine; Robert J. Leitner, all of Sacramento; Gerry E. Leick, Rio Linda, all of Calif.

[73] Assignee: United States Computer Services, Sacramento, Calif.

[21] Appl. No.: 591,218

[22] Filed: Jan. 17, 1996

[51] Int. Cl.[6] ..... B65B 43/36; B65B 57/10

[52] U.S. Cl. ..... 53/493; 53/495; 53/569; 53/381.5; 53/385.1

[58] Field of Search ..... 53/381.5, 385.1, 53/569, 75, 76, 284.3, 460, 493, 495

[56] References Cited

U.S. PATENT DOCUMENTS

| | | | |
|---|---|---|---|
| 3,410,053 | 11/1968 | Bonsch . | |
| 3,858,381 | 1/1975 | Huber et al. | 53/284.3 X |
| 4,149,356 | 4/1979 | Palmer | 53/381.6 X |
| 4,248,032 | 2/1981 | Woods et al. | 53/570 |
| 4,365,458 | 12/1982 | Palmer et al. | 53/381.6 X |
| 4,393,640 | 7/1983 | Cole et al. | 43/385.1 X |
| 4,577,848 | 3/1986 | Hams | 53/284.3 X |
| 4,649,691 | 3/1987 | Buckholz | 53/284.3 X |
| 4,712,359 | 12/1987 | DePasquale et al. | 53/284.3 X |
| 4,781,013 | 11/1988 | DePasquale et al. . | |
| 4,798,040 | 1/1989 | Haas et al. | 53/569 X |
| 4,903,456 | 2/1990 | Meur | 53/381.5 |
| 4,903,457 | 2/1990 | Dimur | 53/381.5 X |
| 4,922,689 | 5/1990 | Haas et al. | 53/284.3 X |
| 4,924,657 | 5/1990 | Berti et al. | 53/75 X |
| 5,097,654 | 3/1992 | Latsounas et al. . | |
| 5,125,214 | 6/1992 | Orsinger et al. | 53/284.3 X |
| 5,457,941 | 10/1995 | Long et al. | 53/284.3 X |
| 5,555,701 | 9/1996 | Fehringer et al. | 53/75 |
| 5,555,703 | 9/1996 | Gombault et al. | 53/284.3 X |

*Primary Examiner*—Horace M. Culver
*Attorney, Agent, or Firm*—James M. Ritchey

[57] ABSTRACT

An envelope opening apparatus for mail assembly operations which employs timed intermittent bursts of compressed air or other gas. One or more gas jets are used in association with an inserter arm, and envelopes are sequentially conveyed past the inserter arm and gas jets. As each envelope is positioned adjacent to the inserter arm and gas jets, a controller computer activates a control valve, supplying compressed air to the gas jets, which direct a blast of air at the envelope, opening the envelope to form a pocket suitable for insertion thereinto of mail materials.

17 Claims, 4 Drawing Sheets

ENVELOPE OPENING APPARATUS

BACKGROUND OF THE INVENTION

1. Field of the Invention

The invention pertains generally to devices and methods for insertion of mail materials into mailing envelopes, and more particularly to an air nozzle inserter apparatus wherein blasts of compressed air or other gas are used to open envelopes for insertion.

2. Description of the Background Art

Large scale, high volume mailing operations, such as the issuance of periodic billing statements or mass advertising, are generally carried out by high speed mail processing and mail assembly systems which facilitate several mail preparation steps. Operations carried out by such mail processing systems typically include the printing, organizing, collating, and folding of mail materials, insertion of the mail materials into envelopes, envelope sealing, postage metering, and other operations. Mail processing and assembly operations are frequently carried out under computer control, which permits high speed mail preparation.

The envelope insertion operation is generally carried out with a conventional inserter apparatus which provides for the collecting or assembling of several sheets of mail materials together into packets, and the insertion of the assembled packets into envelopes. In standard inserter devices, a stream of opened envelopes is generally conveyed past an inserter arm by a conveyor system. Individual inserts are obtained from insert hoppers and added to billing statements or other items to form packets, and the assembled packets are sequentially directed by conveyor means to the inserter arm. The inserter arm then inserts or stuffs each packet of mail materials into an opened envelope by pushing the packet with pusher members or pusher fingers. The filled or stuffed envelopes are then generally directed to an envelope sealing operation.

In order to facilitate the insertion operation, the inserter device generally holds the envelopes open while the inserter arm directs the assembled packets thereinto. Most frequently, suction or vacuum means are been used for holding envelopes open for insertion. The vacuum means typically comprises a plurality of flexible suction cups, in communication with a vacuum source, which are mounted on a movable arm or member. As each envelope is conveyed past the inserter arm, the suction cups are lowered onto the top or upper surface of the envelope, and vacuum is applied to lift the upper surface and hold the envelope open, creating a pocket for the insertion of the assembled packet of mail materials. Following the insertion, the vacuum is removed and the suction cups are moved away, releasing the top surface of the envelope and allowing the stuffed envelope to proceed onward to subsequent mail processing operations such as envelope sealing.

Some important drawbacks are associated with the aforementioned use of vacuum to hold envelopes open during insertion operations. Particularly, the time required to properly open envelopes by applying vacuum in the above manner slows down the overall insertion operation, which could otherwise proceed at a faster rate. This reduced speed at the insertion step slows down the entire mail preparation operation. Further, the use of vacuum means does not provide reliable envelope opening for insertion. For example, if small amounts of dust or other contaminant are present on an envelope upper surface, one or more suction cups may fail to adhere to the envelope, resulting in failure to open or incomplete opening of the envelope, so that the assembled packet, when pushed into the envelope by the inserter arm, does not properly enter the envelope, causing envelope damage and paper jams, which can lead to system shutdown and delay while and operator corrects the jam.

The problems associated with the use of vacuum means for opening envelopes prior to insertion has led to the development of envelop opening devices and systems which utilize air jets or blowers to open envelopes prior to insertion. However, previous envelope opening devices and methods using air jets or blowers have proved deficient in various respects. Particularly, the background art devices generally use a continuous stream or jet of air directed towards passing envelopes on a conveyor system to open the envelopes, resulting in unnecessary drain of air from the compressed air source and interfering with other mail processing operations which rely on the same compressed air source. The use of timed or pulsed air blasts may be used to remedy these problems, but effective delivery of correctly timed air pulses for envelope opening in high speed insertion operations has not been achieved in the background art.

Thus, there is a need for an envelope opening apparatus which allows insertion of mail materials into envelopes at a higher rate of speed than has heretofore been achieved, which provides correctly timed, intermittent air blasts or pulses to open envelopes, which does not require the use of vacuum means to hold envelopes open for insertion, and which avoids the problems associated with incomplete or incorrect envelope opening during insertion. The present invention satisfies these needs, as well as others, and generally overcomes the deficiencies associated with background art inserter devices and methods.

SUMMARY OF THE INVENTION

An object of the invention is to provide an envelope opening apparatus wherein intermittent releases, blasts, or bursts of compressed air or other gas are timed to synchronize with critical insertion events and directed at opened envelopes to assist in the insertion of mail materials thereinto.

Another object of the invention is to provide an envelope opening apparatus suitable for use in a mail processing system operating under integrated computer control.

Yet another object of the invention is to provide an envelope opening apparatus which avoids envelope damage due to improper insertion of mail materials thereinto.

Further objects of the invention will be brought out in the following portions of the specification, wherein the detailed description is provided for the purposed of fully disclosing the invention without placing limits thereon.

In general terms, the subject invention comprises inserter arm means for pushing mail items into envelopes, one or more nozzle means associated with the inserter arm means for providing blasts of compressed air or other gas to open envelopes, computer control means for activating the nozzle means, and transport means for moving a plurality of envelopes past the inserter arm means and nozzle means. The invention also preferably comprises encoder means, interfaced to the control means, for tracking the position of envelopes in the transport means relative to the inserter arm and nozzle means, and holding means for keeping envelope flaps in an opened position while adjacent the inserter arm means and nozzle means.

By way of example and not of limitation, the inserter arm means is preferably a conventional inserter arm which is mechanically interfaced to a drive shaft of an inserter apparatus. The inserter arm preferably includes one or more pusher members or pusher fingers. The nozzle means preferably includes a plurality of gas jets or nozzles which are positioned adjacent to the inserter arm and aimed generally towards the transport means. Valve means for controlling gas supply to the gas jets is also preferably included with the nozzle means of the invention. The transport means is preferably a belt, track, chain, or other conveyor system which is mechanically driven by the inserter apparatus and which sequentially moves a plurality of suitably positioned envelopes past the inserter arm and gas jets. The control means is preferably a computer controller or like programmed data processor which activates the valve means of the gas jets. The encoder means is preferably a shaft encoder interfaced with the computer controller coupled to a timing shaft of the inserter apparatus. The holding means is preferably a plate or other flat member which is positioned adjacent to the transport means so that the opened envelope flaps are directed beneath the plate, thereby keeping the envelope flaps in an open position for the insertion operation.

In operation of the invention, packets of mail materials are generally assembled from individual sheets provided by a plurality of insert hoppers on the inserter apparatus, and the assembled packets are sequentially conveyed to the inserter arm by standard means. At the same time, a plurality of envelopes are moved past the inserter arm by the transport means, while the envelope flaps are kept open by the holding means. As each envelope moves past the inserter arm, an assembled packet is pushed into the passing envelope by the pusher fingers of inserter arm. As the inserter arm is pushing the packet into the envelope, the gas jets of the nozzle means deliver a blast of compressed gas to the envelope, opening the envelope so that the inserted packet may be received therein. The gas jets are activated and deactivated at the proper times by the computer controller, which tracks the position of the envelopes along the transport means by monitoring the machine cycle of the inserter apparatus via the shaft encoder.

BRIEF DESCRIPTION OF THE DRAWINGS

The invention will be more fully understood with reference to the following drawings, which are for illustrative purposes.

DESCRIPTION OF THE PREFERRED EMBODIMENT

Referring now to FIGS. 1–4, there is shown a preferred embodiment of an envelope opening apparatus in accordance with the subject invention. Generally, the subject apparatus is utilized in connection with an envelope assembly system that assembles mailing pieces for bulk mailing operations. An assembled mailing piece typically comprises an outer mailing envelope, internal forms or folded pages (such as detailed and summary billing statements), inserts (such as advertisements, notices, and the like), a return envelope, and similar items. The mailing envelopes are generally of standard configuration, with each envelope having a flap with an area for adhesive, a body, and a fold region connecting the flap to the body.

Figure 1:
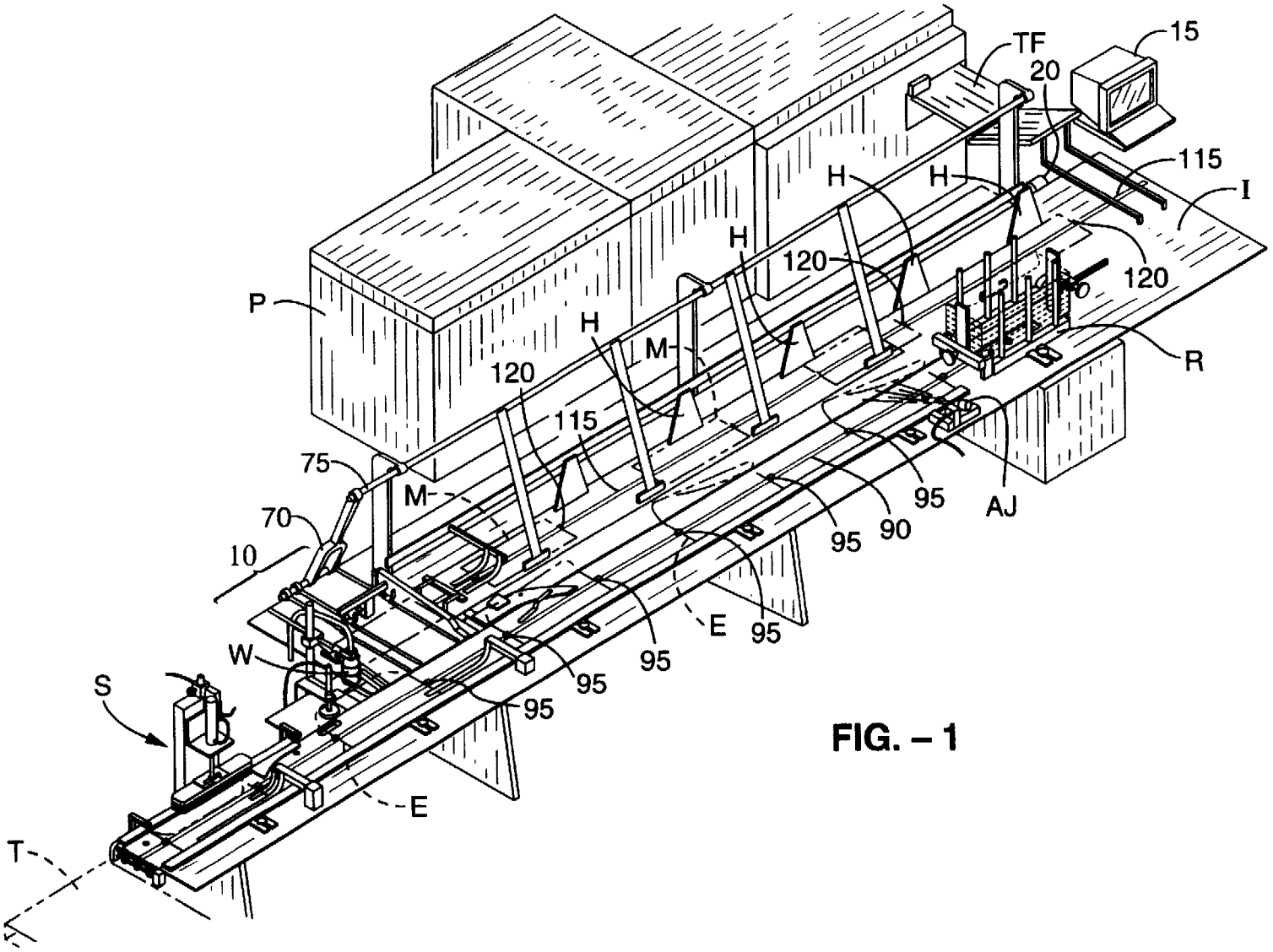
FIG. 1 is a perspective view of an envelope opening apparatus in accordance with the subject invention shown in association with a conventional inserter apparatus.

Referring first to FIG. 1, the mailing piece assembly system comprises a forms or pages source such as a printer P, means for folding or a transport assembly TF for transferring the forms or pages to subsequent equipment, a traditional envelope inserter machine I that assembles various hopper H held inserts and places them into a mailing envelope E, and a transport T apparatus for subsequent processing of the stuffed and sealed envelopes (in particular, see FIG. 1). The subject envelope opening apparatus 10 is preferably positioned along inserter I between an envelope flap air jet opener AJ and envelope wetting W and sealing S devices.

More specifically, the subject invention comprises an envelope opening apparatus having a controller means for overseeing the mail preparation and assembly operation. Although the controller means may be any now known or later developed hardwired or equivalent means, preferably, the controller means is a computer 15 programmed to monitor and direct the assembly of each mailing piece according to appropriate data base and equivalent information. The computer 15 is normally used by an operator and is a stand alone unit or linked directly or indirectly to additional hardware and software, or the equivalent, having additional information and controlling routines. The computer 15 monitors and directs, usually in cooperation with the operator, the various phases of the assembly process.

Since the computer 15 oversees the assembly process, the location of each item comprising the mailing piece is carefully tracked. The computer is configured and equipped with appropriate input devices to detect various errors such as mismatched forms, inserts, envelopes, and the like. Such error detection devices may include readers (bar code readers and the like) that scan for indicia encoded forms, envelopes, inserts, and the like to verify that correct items are within each mailing piece, and photocells which detect the presence or absence of items at various stages of the assembly process. When errors are encountered by the computer 15, the assembly process can be halted or allowed to proceed, depending upon an operator's election or standard protocol.

The subject computer 15 establishes the locations for the various mailing pieces and items to go within the mailing pieces by tracking encoded indicia and/or photocell monitoring at known positions in the apparatus and by utilizing the machine cycle of the typical inserter I. Inserter I generally includes encoder means, which is preferably in the form of a standard shaft encoder 20, and which is coupled to the inserter's central timing shaft (not shown) and utilized to fix the position of any item on the inserter I. Combining the established locations for the error detection scanners with the information derived from the shaft encoder allows the computer to know when each correctly assembled mailing piece is ready for insertion into an envelope E.

Figure 2:
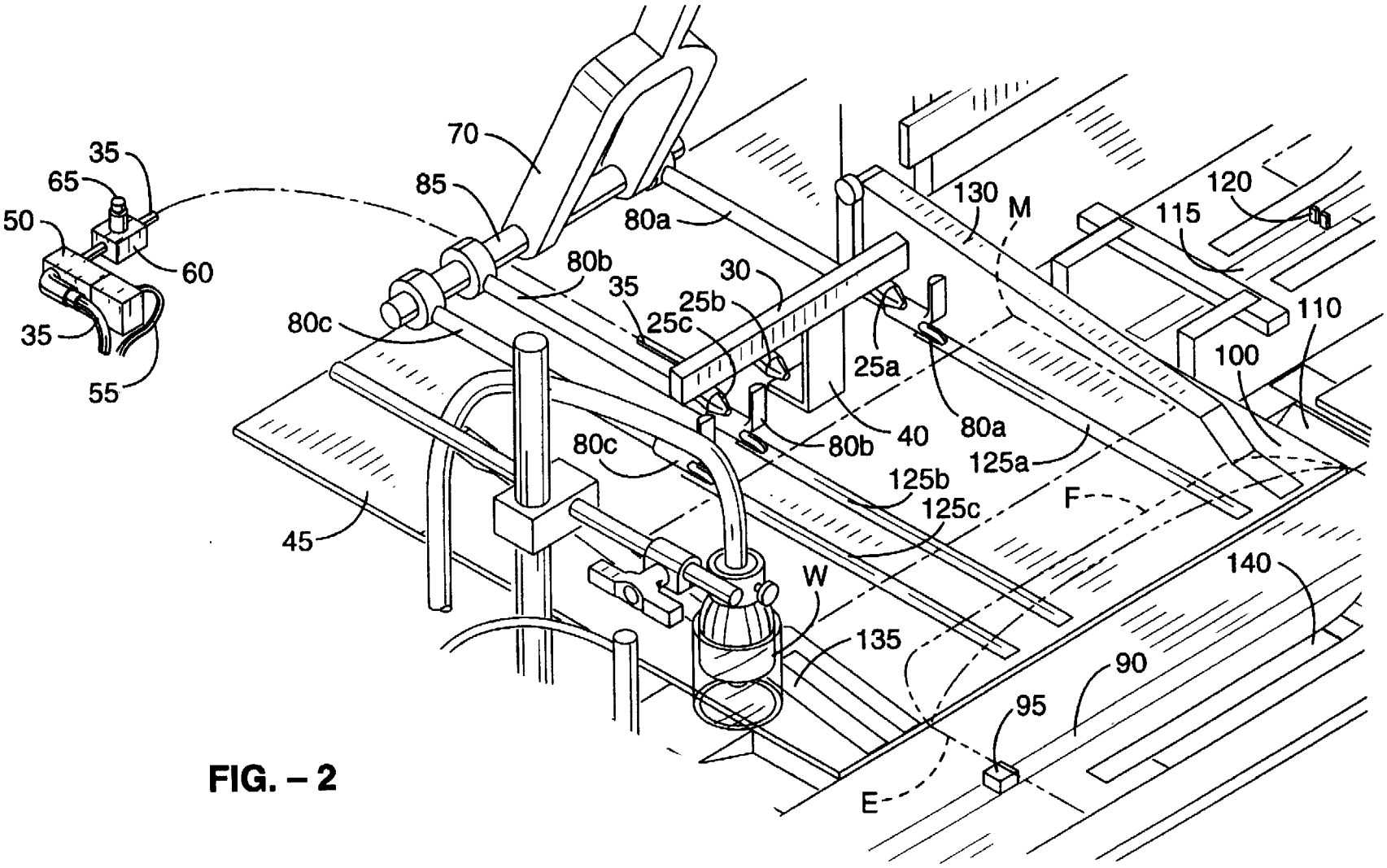
FIG. 2 is a perspective view in detail of the envelope opening apparatus of FIG. 1 showing control valve means in association with the nozzle means of the invention.
Figure 3:
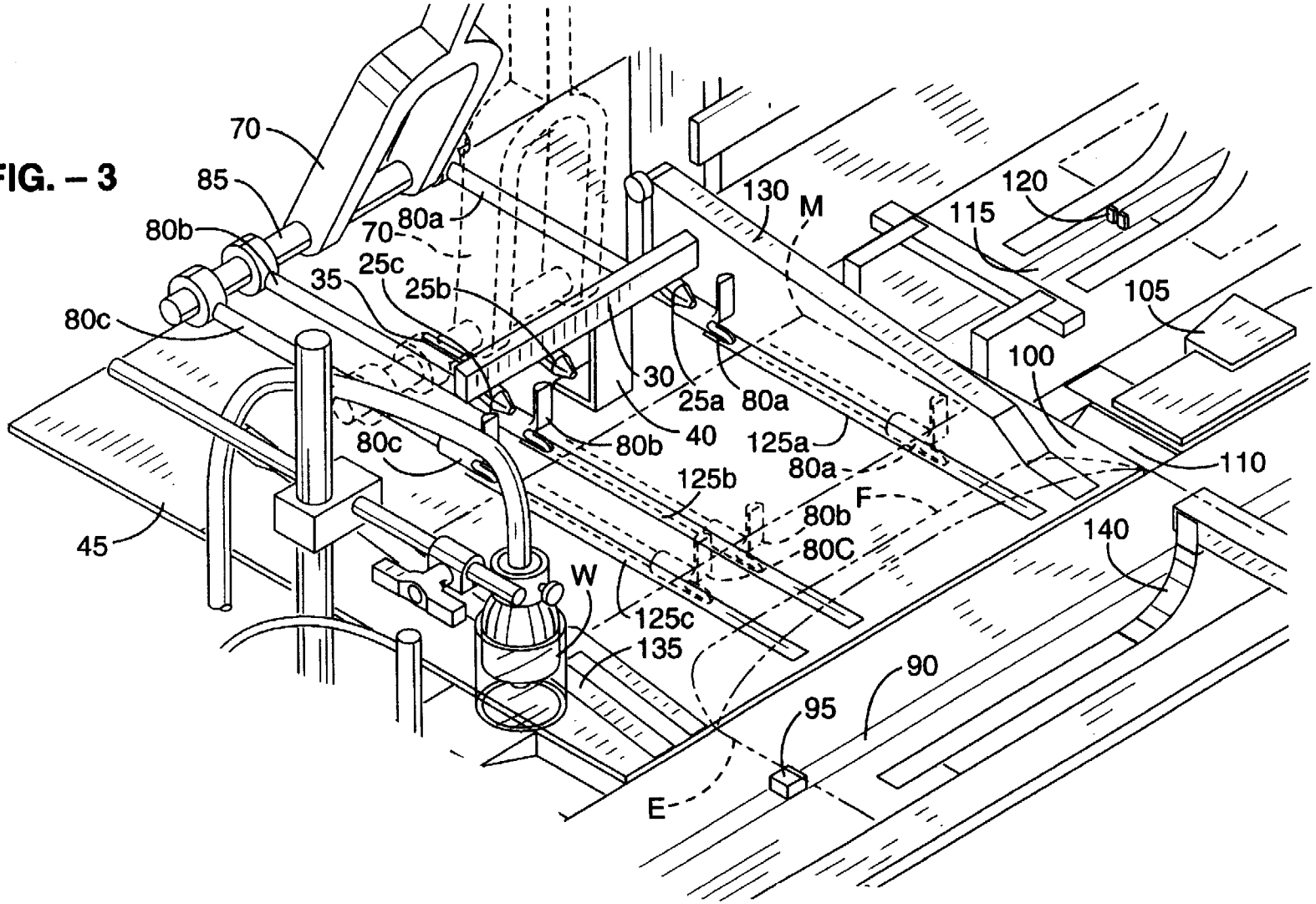
FIG. 3 is a perspective view in detail of the envelope opening apparatus of FIG. 1 showing the range of motion of the inserter arm.
Figure 4:
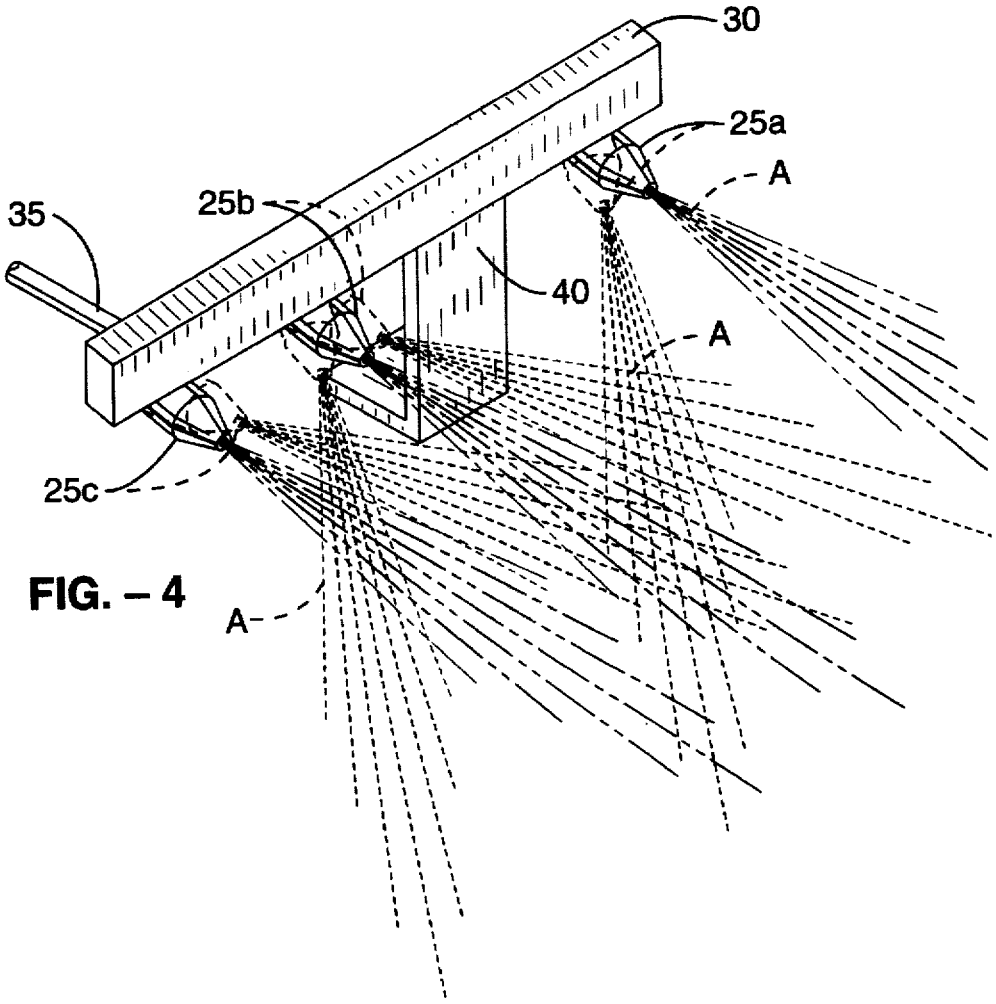
FIG. 4 is a perspective view of the nozzle means of the subject invention.

Referring now to FIG. 2, FIG. 3, and FIG. 4, as well as FIG. 1, the subject envelope opening apparatus 10 includes nozzle means for directing compressed gas to open envelopes. Preferably, the nozzle means comprises a plurality of gas jets 25*a*–25*c* (three jets are shown here, however, two or more than three jets are within the realm of this disclosure) which are mounted on gas manifold 30. A gas supply line 35 is coupled to manifold 30 and provides compressed gas to manifold 30 and jets 25. Manifold 30 is shown mounted on a base 40 which is coupled to plate 45 on inserter I. A larger or smaller number of gas jets 25 may be employed with the invention, depending upon the size and shape of envelope and mail inserts employed with the invention. However, at least two gas jets 25 are generally preferred for effective high speed envelope opening with the invention. Manifold 30, which is preferred for providing compressed gas to a plurality of jets 25, may be omitted if desired, when only one gas jet 25 is employed with the invention. Gas jets 25 preferable are pivotally mounted on manifold 30, so that jets 25 may be aimed or directed at envelopes E, as discussed further below.

Referring more particularly to FIG. 2, the nozzle means also preferably includes valve means for controlling gas supply, which preferably comprise a control valve 50 coupled to gas supply line 35. Control valve 50 is interfaced to controller computer 15 via wire interface 55. Control valve 50 may be solenoid or air actuated, and turns the gas supply to jets 25 on or off according to instructions from controller computer 15. The valve means may also include a hand actuated needle valve 60 coupled to gas supply line 35. Hand actuation of knob 65 on needle valve 60 allows accurate regulation of gas flow rate to gas jets 25. Since different sizes and shapes of envelopes are used in different mail processing operations, varying amounts or volumes of air per each blast or pulse from gas jets 25 are required to hold open different sized envelopes for insertion. Needle valve 60 provides for such control.

The nozzle means of the subject invention preferably utilizes compressed air, with a supply line coupled to an air compressor or compressed air cylinder (not shown). However, other compressed gases such as nitrogen may be employed with the invention.

The subject invention also comprises inserter means, which, in the preferred embodiment, is a conventional inserter arm 70 mounted on a drive shaft 75 (FIG. 1) of inserter I. One or more pusher fingers 80*a*–80*c* are pivotally mounted on inserter arm 70 by rod 85, are used for insertion of assembled mail packets M into envelopes E as discussed below in more detail. The number, position, and structure and configuration of pusher fingers 80 may be varied to accommodate particular mail assembly operations, depending upon the size and shape of mail packets M and envelopes E involved. The inserter means of the invention could alternatively comprise a pusher plate or other member suitably configured for pushing or inserting packets M into envelopes E. Drive shaft 75 drives inserter arm 70 so that inserter arm 70 reciprocates back and forth across plate 45 during the insertion operation, as discussed below in more detail.

Envelope transport means, for sequentially moving a plurality of open envelopes past the inserter means and nozzle means, are also preferably included with the invention. Generally, the envelope transport means comprises a standard track, chain or belt 90 which is mechanically interfaced with and driven by a drive shaft (not shown) on inserter I. A plurality of envelope holding means are included on belt 90, preferably in the form of claws 95, which receive envelopes E from an envelope stack held in rack R (FIG. 1) as belt 90 moves. The envelopes E are held in claws 95 and sequentially moved by belt 90 past envelope flap opener AJ (FIG. 1) wherein the envelope flaps F are folded open or otherwise positioned so that materials may be inserted into envelopes E.

Holding means for keeping envelope flaps F in an opened position are preferably included with the invention. Referring particularly to FIG. 3, in the preferred embodiment the holding means comprises a lip 100 on plate 45, which is adjacent to belt 90. The envelope flaps F, after being opened by flap opener AJ, are directed under blade or plate 105 and down ramp 110 to a lower region under lip 100, which holds or keeps flaps F in an opened position and generally prevents flaps F from interfering with the insertion operation which is carried out on the top surface of plate 45, as related below. Other holding means for keeping flaps F open may also be employed with the subject invention. For example, compressed air or vacuum means may be used in conjunction with plate 45 and lip 100 to hold envelope flaps F open.

Also preferably included with the invention are insert transport means for providing assembled mail materials or mail packets M to the inserter means of the invention. The insert transport means preferably comprises a conventional track, chain, or belt 115 with a plurality of tines 120 or other holding means included thereon. Belt 115 is mechanically interfaced with and driven by a drive shaft (not shown) on inserter I, which may be the same drive shaft powering belt 90 of the envelope transport means. Belt 115 generally extends along the length of inserter I from inserter arm to folding and transfer assembly TF (see FIG. 1). Printed mail or billing statements from printer P are folded by assembly TF and transferred to belt 115, with each set of tines 120 receiving one such statement. Belt 115 conveys or transports the mail statements past each of the plurality of hoppers H, which are vacuum actuated according to the direction of computer 15 to add inserts to the statements, forming assembled mail packets M. Belt 115 then provides the assembled mail packets M, including the inserts from hoppers, to inserter arm 70. The assembled mail packets M generally vary in composition, as mentioned above, but generally include at least one printed and folded statement and at least one insert from one of hopper H on inserter I.

As mentioned above, encoder means are preferably included with the invention for tracking or monitoring the position of envelopes relative to the inserter means and nozzle means of the invention. The encoder means generally comprises a shaft encoder 20 as related above, which is associated with a timing shaft (not shown) or other rotating shaft on inserter I. The timing shaft is mechanically interfaced with the drive shaft or shafts (not shown) which drive belts 90 and 115, and drive shaft 75. Encoder 20 is interfaced with computer 15, and provides the rotational angle information regarding the timing shaft position to computer 15. Encoder 20 thus tracks or monitors the machine cycle of inserter I by monitoring rotation of the timing shaft, and encoder 20 relays this information to computer 15. Since the timing shaft, drive shaft 75, and belts 90 and 115 are all mechanically interfaced, the rotational angle information provided by shaft encoder 20 to computer 15 indicates to computer 15 the location of envelopes E along belt 90, and the location of mail packets M on belt 15. The encoder means of the invention may be incorporated directly into an electric motor (not shown) which powers inserter I, and thus the drive shafts which drive inserter arm 70 and belts 90, 115. In this case, the encoder in the motor would be interfaced directly with controller computer 15, and the machine cycle would be monitored by measuring rotational angles of the motor itself.

In operation of the subject invention, assembled mail packets M, which include printed forms or statements from printer P as well as inserts from hoppers H as related above, are sequentially provided to inserter arm 70 by belt 115 of the insert transport means. Inserter arm 70, as it is driven by drive shaft 75, reciprocates back and forth across the top surface of plate 45, as seen most clearly in FIG. 3. While inserter arm 70 and the attached pusher fingers are in the back position, shown in solid lines in FIG. 3, mail packets M are directed by belt 115 onto the top surface of plate 45, in front of pusher fingers 80. As inserter arm and pusher fingers move into a forward position as indicated by dashed lines in FIG. 3, packet M is pushed across plate 45 toward an envelope E on belt 90, and inserted thereinto. Plate 45 may include a plurality of grooves 125 which slidably accommodate pusher fingers. Inserter arm 70, belt 90, and belt 115 are mechanically interfaced by standard means through inserter I, and are adjusted so that envelopes E are conveyed by belt 90 past inserter arm 70, with envelope flaps held underneath lip 100 on plate 45, at the correct time to receive mail packet M from pusher fingers as inserter arm 70 moves forward. Guides 130, 135 may be employed in association with plate 45, to guide and generally stabilize mail packet M as it is inserted into envelope E by pusher fingers, thereby facilitating high speed insertion operations. A guide member 140 (FIG. 3) may likewise be employed in association with belt 90 to guide and stabilize envelopes E as they receive mail packets M from pusher fingers 80 and inserter arm 70.

As aforementioned, controller computer 15 monitors the machine cycle of inserter I through shaft encoder 20, and thus tracks tho positions of envelopes E on belt 90 and mail packets M on belt 115. As each envelope E on belt 90 is positioned adjacent inserter arm 70 and pusher fingers 80, controller computer signals control valve 50 (FIG. 2) via wire 55, actuating or otherwise activating valve 50 to provide air to the gas jets 25 of the nozzle means of the invention, which then direct a blast of compressed air A (FIG. 4) towards envelope E, causing envelope E to open up in so that mail packet M may be inserted. When envelope E has received packet M or a preset time has elapsed, control valve 50 is directed to shut off the air supply to gas jets 25, terminating the air blast A.

The use of such intermittent or timed air releases, blasts, or bursts as provided by the subject invention is particularly effective for opening envelopes for insertion operations at high speeds, and for avoiding errors due to improper insertion which can cause system shut downs. The nozzle means of the present invention may be employed with a continuous or non-intermittent air blast or burst from gas jets 25 directed towards belt 90, causing each envelope E to remain open while it is within range of gas jets 25. However, the use of a continuous blast of compressed air creates an unnecessary drain on compressed air supplies, which generally are also used elsewhere in the mail assembly operation. The use of a continuous, rather than intermittent air blast or burst A also may hold envelopes E open longer than desired, interfering with the envelope flap wetting operation by wetting apparatus W and envelope sealing operation by sealing apparatus S. Thus, the use of intermittent or timed air blasts or bursts A for envelope opening as described above is preferred.

Gas jets 25 preferably are pivotally mounted on manifold 30 by standard means, as seen most clearly in FIG. 4, so that gas jets 25 and thus air blasts A may be aimed or otherwise controlled to optimize envelope opening for various sizes and types of envelopes. Gas jets 25 may also be re-positioned on manifold in positions other than shown in FIG. 1 through FIG. 4, if required for a particular envelope opening operation. As mentioned above, a larger or smaller number of gas jets 25 may be employed for particular operations, as desired, without departing from the basic concepts as disclosed herein. For most envelope opening operations, two or three gas jets 25 are preferred.

Figure 5A:
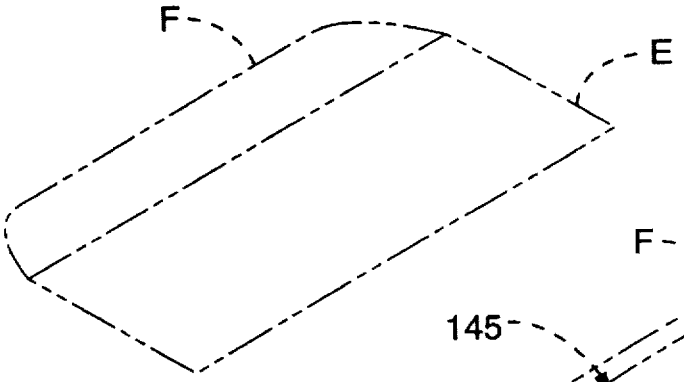
FIG. 5A–5B illustrate the manner of opening an envelope with the present invention to form a pocket for receiving mail materials.
Figure 5B:
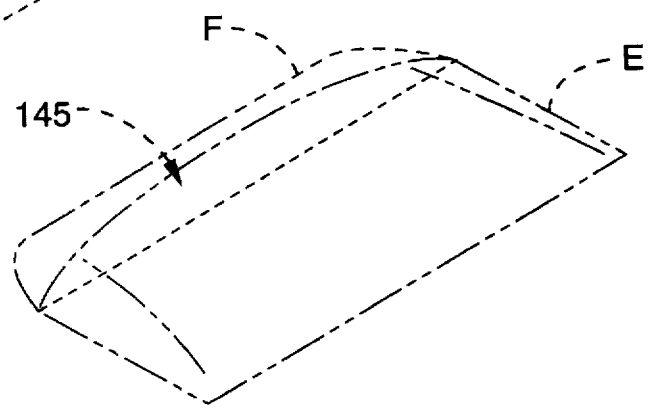

Referring now to FIG. 5A and FIG. 5B as well as FIG. 2, and FIG. 3, the manner in which a standard envelope is opened by the subject invention is generally illustrated. FIG. 5A shows generally the configuration of an envelope E as it is positioned on belt 90 adjacent inserter arm 70 and pusher fingers 80, with flap F held down beneath lip 100 of plate 45, prior to activation of control valve 50 by computer 15 to produce an air blast from jets 25. As can be seen, envelope E lies generally flat, and cannot readily receive a mail packet M from pusher fingers 80. FIG. 5B, as well as FIG. 2 and FIG. 3, show an envelope E under the effect of a compressed air blast from gas jets 25, which causes envelope E to open up, forming a pocket 145 suitable for receiving mail packet M from inserter arm 70 and pusher fingers 80. The formation of open pocket 145 in envelopes E by the compressed air blasts of the invention allow facile, high speed envelope insertion operations with a decreased risk of mis-insertion or jamming associated with background art envelope opening techniques.

Thus, an envelope opening apparatus which employs blasts of compressed air to open envelopes for high speed, error-free insertion operations in mail assembly processes has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. An envelope opening apparatus, comprising:

a) positionally adjustable nozzle means for directing compressed gas to open envelopes;

b) inserter means for placing mail materials into envelopes;

c) envelope transport means for moving a plurality of envelopes horizontally past said inserter means and said nozzle means; and d) an electronic computer control means for activating and deactivating said nozzle means, wherein said electronic computer control means establishes if a correctly assembled mailing piece is ready for insertion into an envelope and open an envelope only if said correctly assembled mailing piece is ready for insertion.

2. An envelope opening apparatus according to claim 1, further comprising holding means for keeping envelope flaps in an opened position, said holding means positioned adjacent said inserter means and said nozzle means.

3. An envelope opening apparatus according to claim 1, further comprising encoder means, interfaced with said computer control means, for monitoring rotational angles for a machine cycle.

4. An envelope opening apparatus according to claim 1, further comprising insert transport means for providing assembled mail packets to said inserter means.

5. An envelope opening apparatus according to claim 3, wherein said control means causes an intermittent release of said compressed gas according to rotational angles detected by said encoder means.

6. An envelope opening apparatus according to claim 1, wherein said nozzle means further comprises valve means, interfaced with said computer control means, for controlling air supply to said nozzle means.

7. An envelope opening apparatus according to claim 6, wherein said valve means comprises a solenoid control valve.

8. An envelope opening apparatus, comprising:

a) at least one positionally adjustable nozzle means for directing compressed gas to open envelopes;

b) inserter means for placing mail materials into envelopes, said inserter means associated with said nozzle means;

c) envelope transport means for sequentially moving a plurality of open envelopes horizontally past said inserter means and said nozzle means; and d) electronic computer control means, interfaced with said nozzle means, for activating a timed release of said compressed gas and deactivating said timed release of compressed gas by said nozzle means according to the position of said plurality of envelopes on said transport means relative to said nozzle means and said inserter means, wherein said electronic computer control means establishes if a correctly assembled mailing piece is ready for insertion into an envelope.

9. An envelope opening apparatus according to claim 8, further comprising encoder means, interfaced with said computer control means, for monitoring rotational angels for a machine cycle.

10. An envelope opening apparatus according to claim 8, further comprising insert transport means for sequentially providing assembled mail packets to said inserter means.

11. An envelope opening apparatus according to claim 8, wherein said timed release of said compressed gas produces intermittent bursts of said compressed gas.

12. An envelope opening apparatus according to claim 8, wherein said nozzle means further comprises valve means, interfaced with said computer control means, for controlling air supply to said nozzle means.

13. An envelope opening apparatus according to claim 12, wherein said valve means comprises a solenoid control valve.

14. An envelope opening apparatus, comprising:

a) an inserter arm, said inserter arm including at least one pusher finger;

b) at least one positionally adjustable gas jet, said gas jet coupled to a gas supply line, said gas supply line including valve means for controlling gas supply, said gas jet positioned adjacent said inserter arm;

c) an envelope conveyor track, said envelope conveyor track positioned adjacent said gas jet, said envelope conveyor track including a plurality of means for holding envelopes;

d) electronic computer control means, interfaced with said valve means, for actuating and deactivating said valve means according to the position of said plurality of envelopes on said envelope conveyor track to produce timed releases of said gas, wherein said electronic computer control means establishes if a correctly assembled mailing piece is ready for insertion into an envelope and open an envelope only if said correctly assembled mailing piece is ready for insertion; and e) an insert conveyor track, said insert conveyor track positioned to provide assembled mail packets to said inserter arm.

15. An envelope opening apparatus according to claim 14, further comprising encoder means, interfaced with said computer control means, for monitoring rotational angels for a machine cycle.

16. An envelope opening apparatus according to claim 14, further comprising means for holding envelope flaps in an opened position, said holding means positioned adjacent said inserter arm and said gas jet.

17. An envelope opening apparatus according to claim 14, wherein said timed releases of said compressed gas produce intermittent bursts of said compressed gas.

* * * * *

UNITED STATES PATENT AND TRADEMARK OFFICE

CERTIFICATE OF CORRECTION

PATENT NO : 5,722,221

DATED : March 3, 1998

INVENTOR(S) : Richard D. Maltman, Robert E. Valentine, Robert J. Leitner, and Gerry E. Leick It is certified that error appears in the above-identified patent and that said Letters Patent is hereby corrected as shown below:

On title page, item 73 Assignee
replace "United States Computer Services, Sacramento, Calif."
with --International Billing Services, Inc., Rancho Cordova, Calif.--.

Signed and Sealed this

Tenth Day of November 1998

*Attest:*

*Attesting Officer*

BRUCE LEHMAN

*Commissioner of Patents and Trademarks*